US006502704B2

(12) United States Patent
Martorella et al.

(10) Patent No.: US 6,502,704 B2
(45) Date of Patent: Jan. 7, 2003

(54) DEVICE FOR DRYING OBJECTS

(75) Inventors: Rudolph Martorella, Great Neck, NY (US); R. Christopher Kidd, New York, NY (US)

(73) Assignee: Rudolph Martorella, Great Neck, NY (US)

( * ) Notice: Subject to any disclaimer, the term of this patent is extended or adjusted under 35 U.S.C. 154(b) by 0 days.

(21) Appl. No.: 09/757,216

(22) Filed: Jan. 9, 2001

(65) Prior Publication Data

US 2001/0040141 A1 Nov. 15, 2001

Related U.S. Application Data

(63) Continuation-in-part of application No. 09/568,915, filed on May 11, 2000, now Pat. No. 6,357,605.

(51) Int. Cl.[7] ..... A47G 19/08
(52) U.S. Cl. ..... 211/41.6; 211/41.5
(58) Field of Search ..... 211/41.6, 41.2, 211/41.3–5, 2, 133.5, 132.1, 70.7, 85.25, 90.03, 106, 119.003, 181.1; D32/55–57; 248/448, 449, 454–457, 463–465, 465.1

(56) References Cited

U.S. PATENT DOCUMENTS

| | | | | | |
|---|---|---|---|---|---|
| 378,692 | A | * | 2/1888 | Latham | 211/41.5 |
| 815,480 | A | * | 3/1906 | Silven | 211/41.5 |
| 990,454 | A | * | 4/1911 | Peters | 211/41.5 |
| 1,564,594 | A | * | 12/1925 | Leh | |
| 1,712,342 | A | * | 5/1929 | Fitzgerald | 211/41.6 |
| 1,714,629 | A | * | 5/1929 | Rodin | 211/41.6 |
| 1,822,087 | A | * | 9/1931 | Feingold | 211/41.5 |
| 2,443,404 | A | | 6/1948 | Tallarico | |
| 2,479,118 | A | | 8/1949 | Jenness | |
| 2,516,088 | A | | 7/1950 | Einhorn | |
| 2,708,037 | A | * | 5/1955 | Planeta | 211/41.5 |
| 2,841,288 | A | * | 7/1958 | Field et al. | 211/41.5 |
| 2,936,898 | A | * | 5/1960 | Miguez | 211/41.3 |
| 2,958,424 | A | * | 11/1960 | Bigatti | 211/41.5 |
| 3,025,967 | A | * | 3/1962 | Christopersen | 211/41.5 |
| 3,027,041 | A | * | 5/1962 | Stansbury, Jr. et al. | 211/41.3 |
| 3,464,566 | A | * | 9/1969 | Gilson | 211/41.9 |
| 4,169,638 | A | * | 10/1979 | Cirasuolo et al. | 211/41.6 |
| 4,726,475 | A | * | 2/1988 | Ferenzi | 211/41.5 |
| 4,756,582 | A | | 7/1988 | Heien | |
| 4,969,560 | A | * | 11/1990 | Stanfield | 211/41.5 |
| 5,119,943 | A | * | 6/1992 | Hoang | 211/41.3 |
| 5,332,105 | A | * | 7/1994 | Stanfield | 211/41.3 |
| 5,480,035 | A | * | 1/1996 | Smith | 211/41.5 |
| 5,485,927 | A | | 1/1996 | Hubbard | |
| 5,503,279 | A | * | 4/1996 | Wentworth | 211/181.1 |
| 5,651,525 | A | * | 7/1997 | Yang | |
| 6,170,676 | B1 | * | 1/2001 | Patadia et al. | 211/41.6 |
| 6,179,134 | B1 | * | 1/2001 | Pine et al. | 211/41.3 |

* cited by examiner

*Primary Examiner*—Daniel P. Stodola
*Assistant Examiner*—Jennifer E. Novosad
(74) *Attorney, Agent, or Firm*—Collard & Roe, P.C.

(57) ABSTRACT

A device for supporting objects for drying. This device contains a catch basin, for receiving fluid that drips off of these drying objects. Attached to the catch basin is a first adjustable rack, having a front end and a back end. The back end of the first adjustable rack is rotatably supported within the catch basin. There is also a second adjustable rack disposed in the basin. Both the first adjustable rack and the second adjustable rack are comprised of a series of parallel extending bars that are spaced apart from each other to receive a plate between these parallel extending bars. These parallel extending bars are also designed to support a series of pots on either the first adjustable rack or the second adjustable rack wherein these parallel extending bars allow water to drip down through the bars and into the catch basin. In addition, there is also an adjustable tray disposed adjacent to the adjustable racks wherein the adjustable tray is designed to support kitchen utensils and silverware in an upright manner for drying. This device can also be collapsed to allow this device to be folded up to stand freely upright on a substantially horizontal surface.

4 Claims, 12 Drawing Sheets

131
135
136
128
140
129
114'
114"
113
114
111
112"
112"
112
116
152
154
150
162
160
164
120
127
124
122
156
121
126
121'
127
123
125

DEVICE FOR DRYING OBJECTS

This application is a continuation-in-part of U.S. patent application Ser. No. 09/568,915 filed on May 11, 2000 now issued as U.S. Pat. No. 6,357,605 under which priority is claimed under 35 U.S.C. §120 issued Mar. 19, 2002.

BACKGROUND OF THE INVENTION

FIELD OF THE INVENTION

The invention relates to a device for supporting objects for drying. More particularly, this invention relates to an adjustable device that is designed to allow plates, pots, kitchen utensils and silverware to dry.

SUMMARY OF THE INVENTION

The invention relates to a device for supporting objects for drying. This device contains a catch basin, for receiving water that drips off of these drying objects. Attached to the catch basin is a first adjustable rack that is positioned in a substantially horizontal manner. This first adjustable rack has a front end and a back end wherein the back end is rotatably supported within the catch basin. In addition, there is also a second adjustable rack that is rotatably attached to the catch basin and extends in a substantially upright or vertical position. Both the first adjustable rack and the second adjustable rack are comprised of a series of parallel extending bars that are spaced apart from each other to receive a plate between these parallel extending bars or to allow pots to rest thereon. The bars are spaced far enough apart so that they allow water to drip down through the bars and into the catch basin.

In addition, there is an adjustable support bar that is rotatably attached to the substantially horizontal adjustable rack. This adjustable support bar is for rotatably adjusting the height of the front end of the substantially horizontal adjustable rack. Furthermore, disposed within the catch basin is a series of support strips wherein the support strips are designed to support the adjustable support bar in a particular position to keep the adjustable support bar from rotating or sliding when the support bar is supporting the substantially horizontal adjustable rack. The support bar is also useful in that when it is positioned flat, it extends out from the substantially horizontal rack to support extra large pots or pans.

This device is also designed to prevent any water or other materials from flowing onto a counter top outside of the catch basin. For example, the catch basin contains a series of substantially vertical walls to trap this water within the catch basin. In this way, the water will not flow outside of the catch basin and onto a counter top. However, there are at least two drainage holes disposed within the substantially vertical walls to allow a user to easily pour the water disposed within the catch basin out into a sink. In a second embodiment of the invention, a back wall on the basin is curved in to provide additional lateral support for the device.

The device also contains an adjustable tray attached to the catch basin for supporting a series of utensils. The adjustable tray also comprises a set of adjustable legs rotatably attached to the catch basin, a top plate attached to the adjustable legs wherein this top plate has holes for supporting the silverware and utensils in an upright manner. The top plate is adjustable from a folded up position to a folded down position so that the tray can be stored easily.

One of the benefits of this invention is that it can be folded down into a storage position wherein the rack can then be stored away. To facilitate this feature, there is also a catch block disposed within the catch basin wherein this catch block is designed to receive a top end spacer bar on the second adjustable rack to lock the top end spacer bar in place on the catch block. The catch block also contains a slot that is angled in so that it restricts the movement of the spacer bar in the second adjustable rack once the second adjustable rack is snapped in. This second adjustable rack snaps into place over the first adjustable rack so that it locks both racks in place within the catch basin.

Essentially, this device is unique because the first rack in conjunction with the adjustable support bar is designed to create both a dish drying rack and a pot drying rack. When the substantially horizontal rack is supported above a horizontal position, with the adjustable support bar being supported by one of the support strips, the device is designed to support dishes and small to medium sized pots. When the first or substantially horizontal support rack is raised above its horizontal position, this rack gains clearance above the catch basin to receive plates through its parallel extending bars. In addition, with the substantially horizontal rack in this raised position, it creates an angled surface which forces plates to also extend through the second, opposite angled substantially vertical rack. While the device in this position is primarily designed to receive plates, small to medium sized pots can also be placed on the first or substantially horizontal rack for drying.

This device can be adjusted to form a pot drying rack. This pot drying rack is formed when the first or substantially horizontal rack is extended out in a substantially horizontal manner, wherein the support bar is extended out to a series of support elements. When the support bar is extended out, it forms an additional drying surface at substantially the same elevation as the first rack. Because of this additional surface area for drying, this first rack along with the support bar is designed to receive many pots or pans, of small, medium or large size. Now pots with a larger diameter than the width of the first rack can be placed on this first rack and extend out to be supported by this support bar resting on the support elements.

In addition, the utensil rack can be folded down into a substantially horizontal position at an elevation similar to the elevation of this substantially horizontal rack. With this design, the utensil rack in its folded down position, forms an additional pot drying surface which can receive pots that are either placed directly onto the folded down utensil rack, or pots placed onto the first drying rack but hang over this first drying rack.

When the device is in this position, it is a pot drying rack because when the first rack is in its substantially horizontal position, it can no longer support dishes. This is because this first rack is far closer to the bottom of the support basin thereby cutting off a region to receive the plates as they slide through the parallel extending bars. In addition, when the first rack is in this position, it no longer supplies lateral support to the dishes. This lateral support is required to support dishes because the lateral support results in the first rack pushing the dishes into the second, substantially vertical rack.

This device is also unique because it can be tilted up on its end and allowed to stand on a base so that this device can be placed out of the way. This feature occurs because this device contains a unique base that allows this device to stand on one end and because this device is uniquely balanced along a latitudinal axis which extends substantially horizontal when the device is in use on a counter top but extends substantially vertical when the device is tilted up for storage.

The base, which is coupled to the device can be made from any desired shape, but is designed to allow the device to stand up on an end for storage. This base is in the form of but not limited to: a series of legs, a flat back face on the basin, a separate plate connected to the basin, or any other shape to create a support surface on a counter top.

In addition, the design of this device creates a weight balanced device once it is in its compact form. This weight balance allows the device to be free standing on its base so that this device does not need any additional fixtures or support from an adjacent wall or counter surface. For example, once, all three racks: the first rack, the second rack and the utensil rack have been folded down to compact the device, this device is balanced along its latitudinal axis. Now the device can be folded up on its base to be stowed away on a counter top as a free standing device without any support from adjacent walls.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
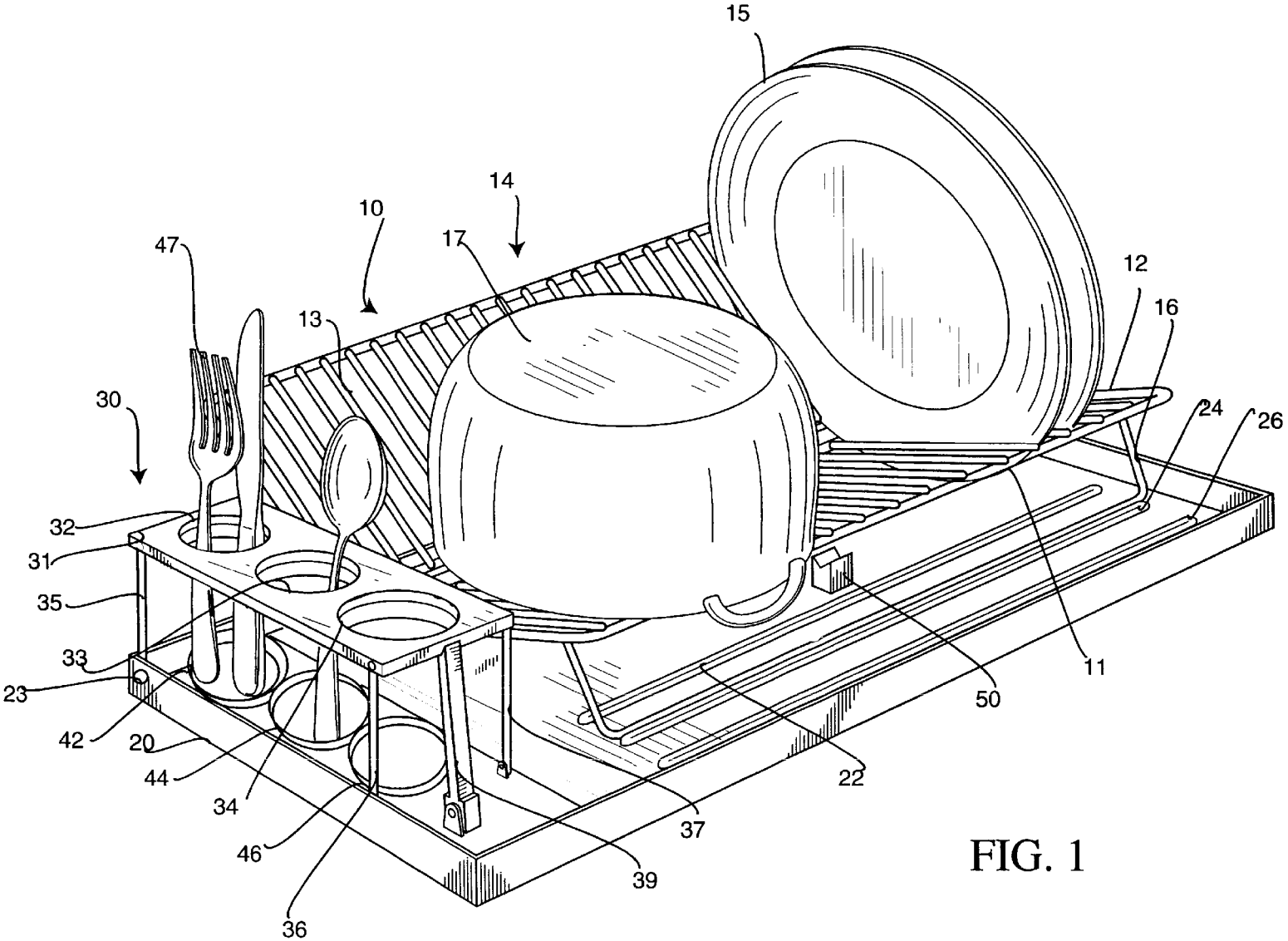
FIG. 1 represents a perspective view of the first embodiment of the invention on a counter top in a position for supporting plates, a pot, and silverware for drying.

FIG. 1 refers to a perspective view of the invention wherein there is shown a device 10 for drying plates, pots and silverware. Here, there is a first rack 12 rotatably attached to a catch basin 20, and a second rack 14 rotatably attached to catch basin 20. Both first rack 12, and second rack 14 contain a series of parallel extending bars 11 and 13 respectively that are secured at both ends by first and second spacer bars 12', 12", 14', and 14" on first and second racks 12 and 14 respectively. These parallel extending bars 11 and 13 are spaced apart to receive a series of plates 15 or at least one pot 17 and also to allow water to drip off of plates 15, pots 17 and into catch basin 20. Water can then be drained from catch basin 20 via a drainage hole 23 positioned on a side wall of catch basin 20.

Figure 2:
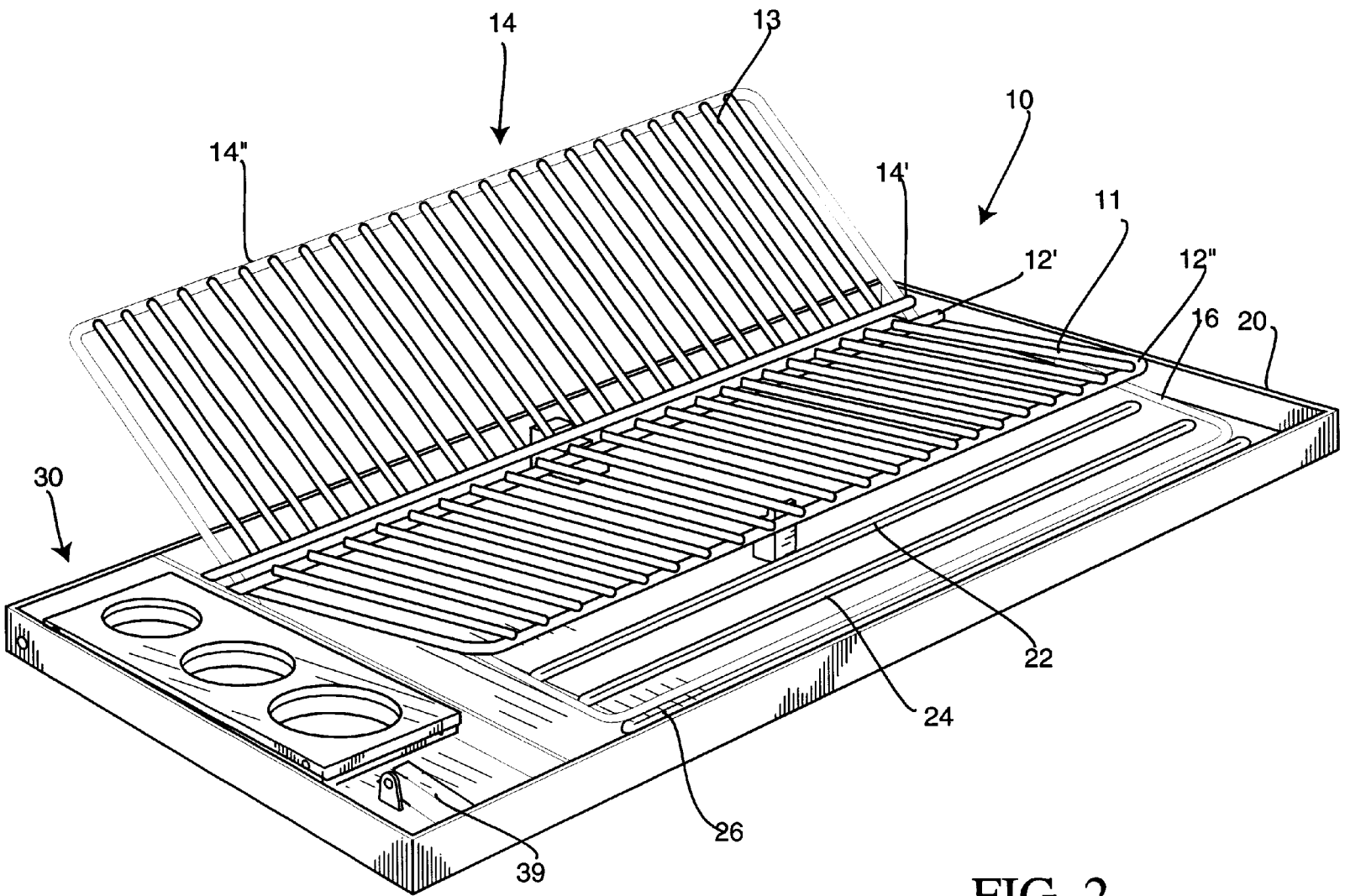
FIG. 2 represents a perspective view of the first embodiment of the invention wherein the first adjustable rack is extended in a downward position.

As shown in FIG. 2, the first rack 12 contains a first end bounded by spacer bar 12' that is rotatably mounted within catch basin 20 and a second end bounded by spacer bar 12" that extends across catch basin 20. Attached to the second end of first rack 12 is a support bar 16 for supporting the second end of the first rack 12 at different elevations.

The elevation of the second end of the first rack can be set by setting support bar 16 within one of three different support strips 22, 24, and 26 designed to receive support bar 16. These support strips extend parallel across catch basin 20 so that support bar 16 can rest against each support strip to position the second end 12" of first rack 12 at varying heights. The support bar 16 is pushed against each support strip by a gravitational force exerted by first rack 12. In addition, if there are any plates 15, or pots 17 placed on first rack 12, this also exerts an additional gravitational force on support bar 16 to further set support bar 16 against one of the support strips 22, 24, or 26.

The elevation of the second end 12" of first rack 12, narrows the distance between first rack 12 and second rack 14 so that different sized plates or pots can fit snugly between parallel extending bars 11 and 13 on first rack 12 and second rack 14 respectively.

In addition, disposed adjacent to first rack 12 and second rack 14, is a tray 30 designed to support kitchen utensils and silverware 48 in an upright position. In this case, tray 30 consists of a plate 31 that has a series of holes 32, 33, and 34 (FIG. 1) that are designed to receive these kitchen utensils (not shown) and silverware 48 within, while supporting these objects in an upright manner.

Plate 31 is supported by a series of supporting arms 35, 36, 37, and a fourth arm (not shown) while this plate 31 is held in place by a support arm 39 designed to fix plate 31 in place. In this way, plate 31 provides a support for holding plate 31 in place which holds kitchen utensils or silverware as they are drying.

Disposed below plate 31 is a series of circular containers or storage bins 42, 44, and 46 serving as lateral supports for the silverware 48 or utensils, not shown. These containers are designed to receive the utensils 48 to provide lateral support for utensils allowing them to stand in a substantially vertical manner within plate 31.

Figure 3:
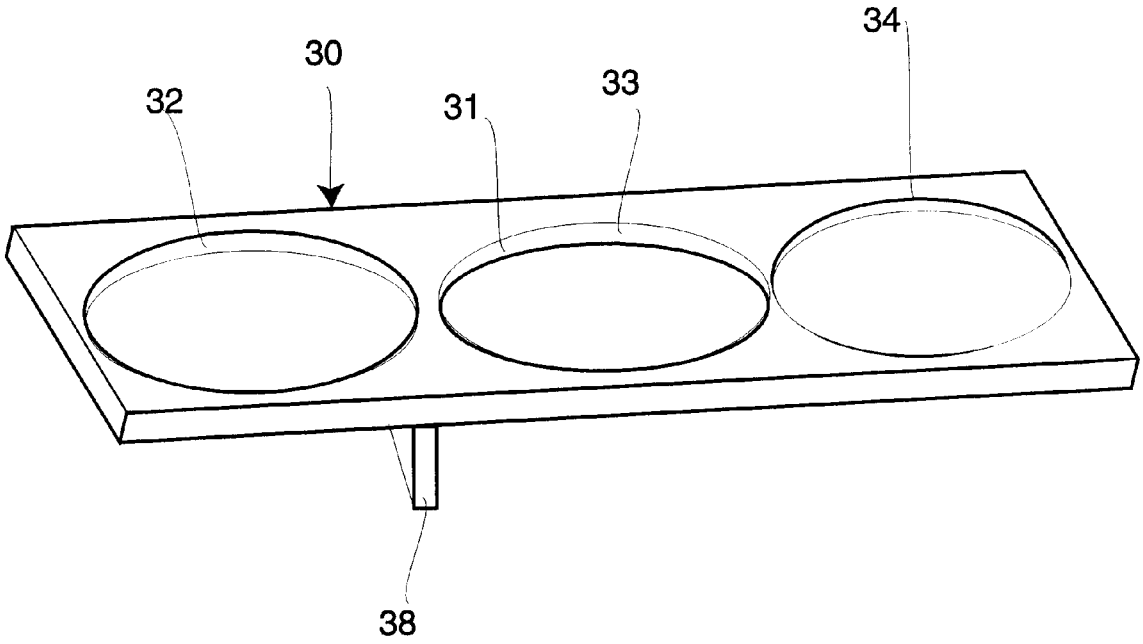
FIG. 3 shows a side view of the first embodiment of the invention showing a tray for supporting silverware.

Both tray 30, first rack 12, second rack 14 and support bar 16 can be folded down so that device 10 can be collapsed into a substantially flat position using a tab 38 as shown in FIG. 3. Tab 38 is disposed between holes 32 and 33 and extends down from plate 31 so that a user can simply reach his or her fingers into holes 32 and 33 and grip tab 38 to either raise or lower plate 31. Plate 31 can be positioned in a lowered position as shown in FIGS. 2 and 5.

Figure 4:
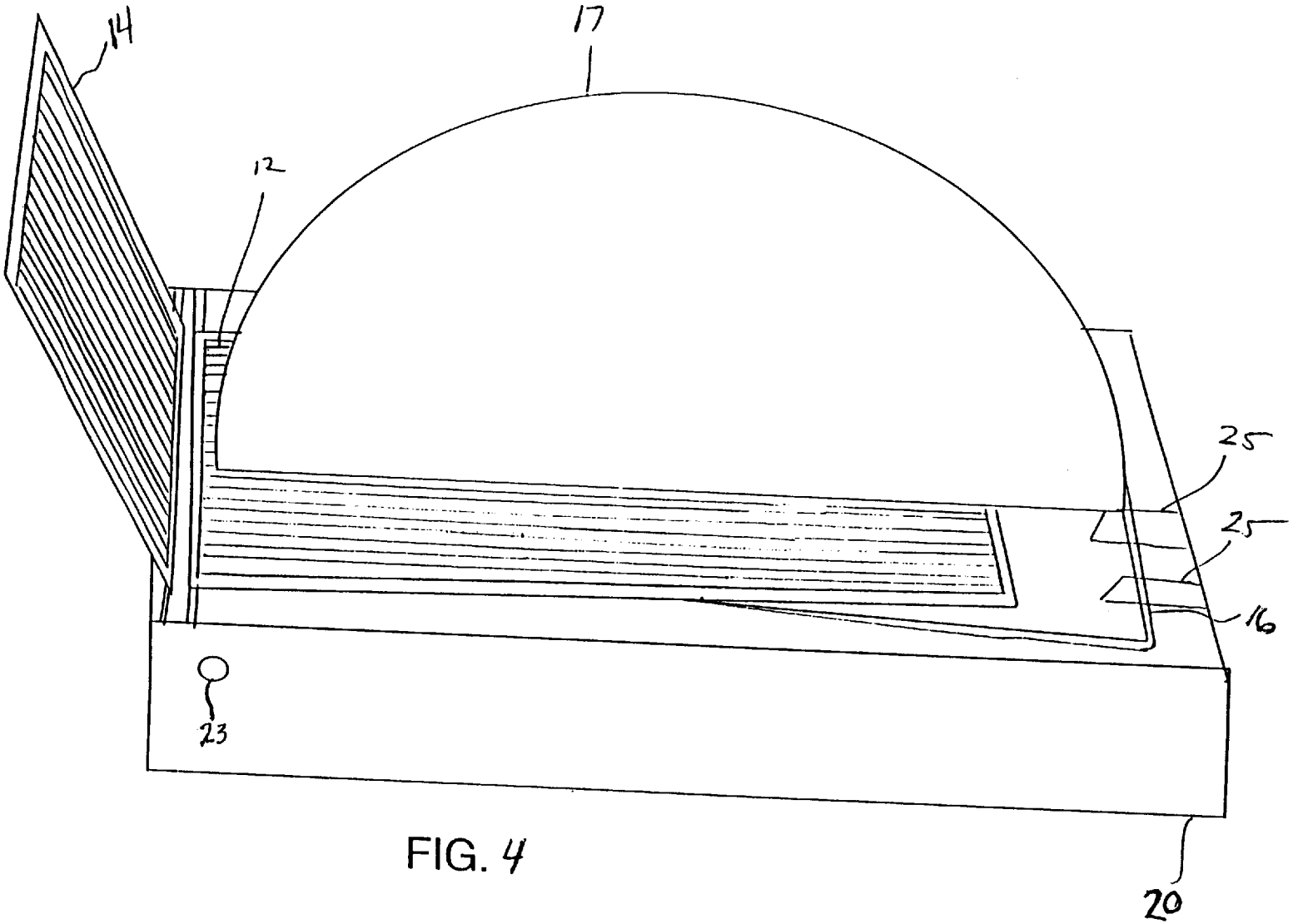
FIG. 4 shows a perspective view of the first embodiment of the invention wherein the first adjustable rack is extending in a downward position and the support bar extends out to support a large bowl.

As shown in FIG. 4, when rack 12 is folded down into a substantially flat position, support arm 16 extends out so that it is supported on support ridges 25 that lend support to support arm 16. In this way, support arm 16 forms a substantially horizontal support that extends out beyond first rack 12 to support especially large pots. At this point, the device turns into a pot drying rack for supporting multiple pots or particularly large pots.

Figure 5:
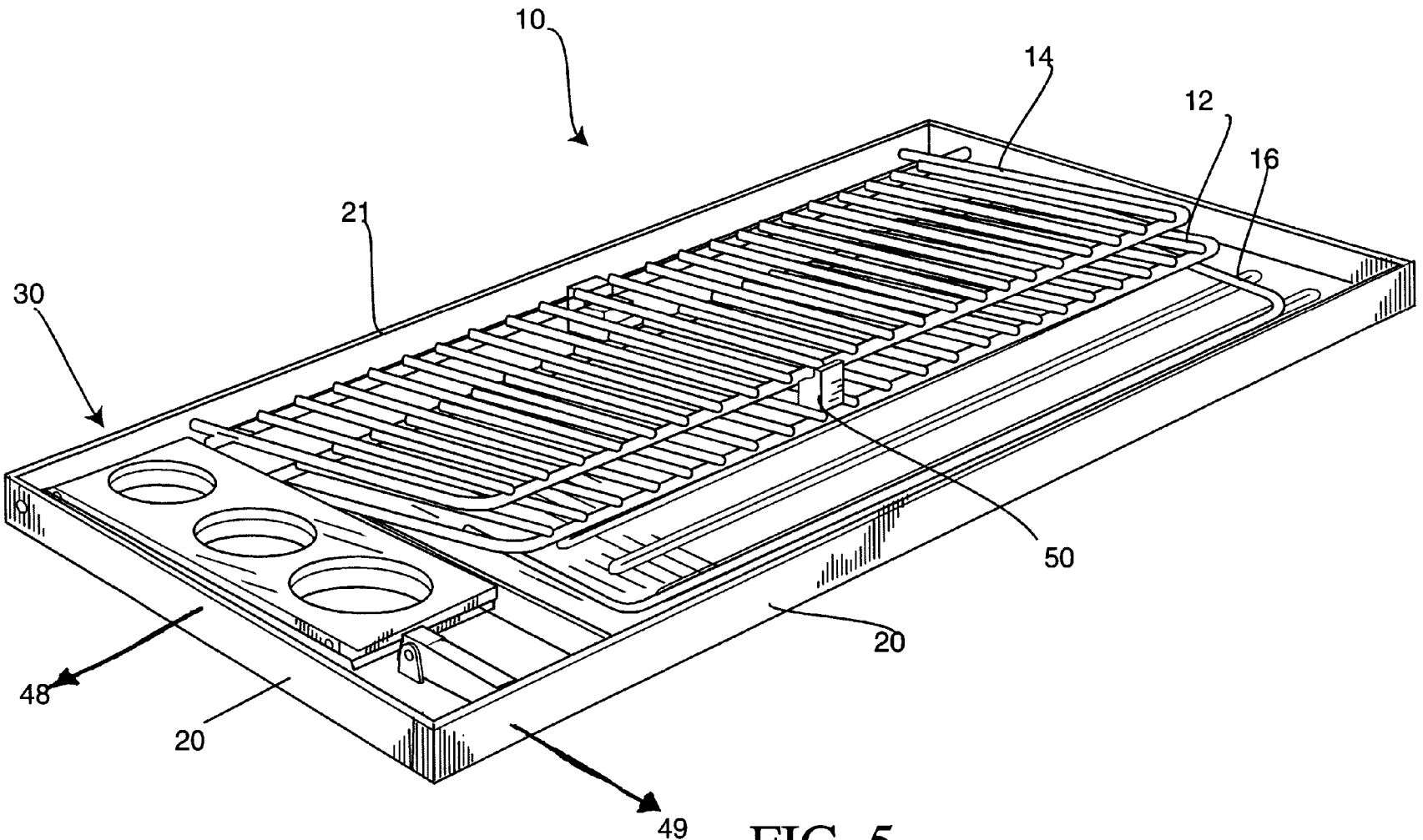
FIG. 5 is a perspective view of the first embodiment of the invention in the folded down position.
Figure 6:
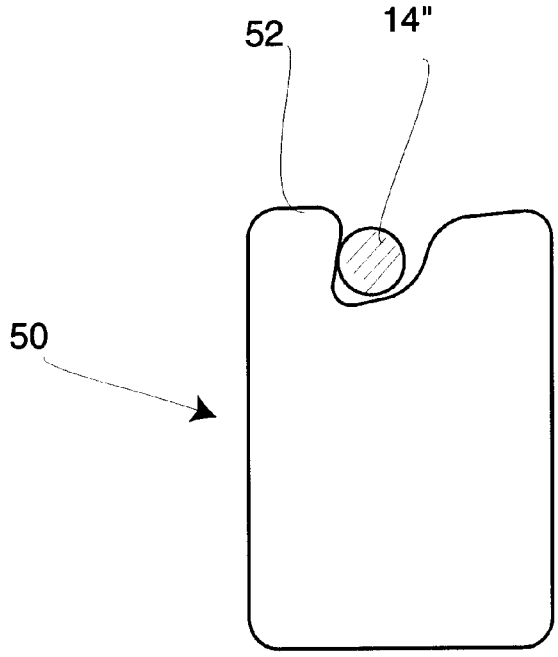
FIG. 6 is a side view of first embodiment of a catch block for catching the front end of the second adjustable rack.
Figure 8:
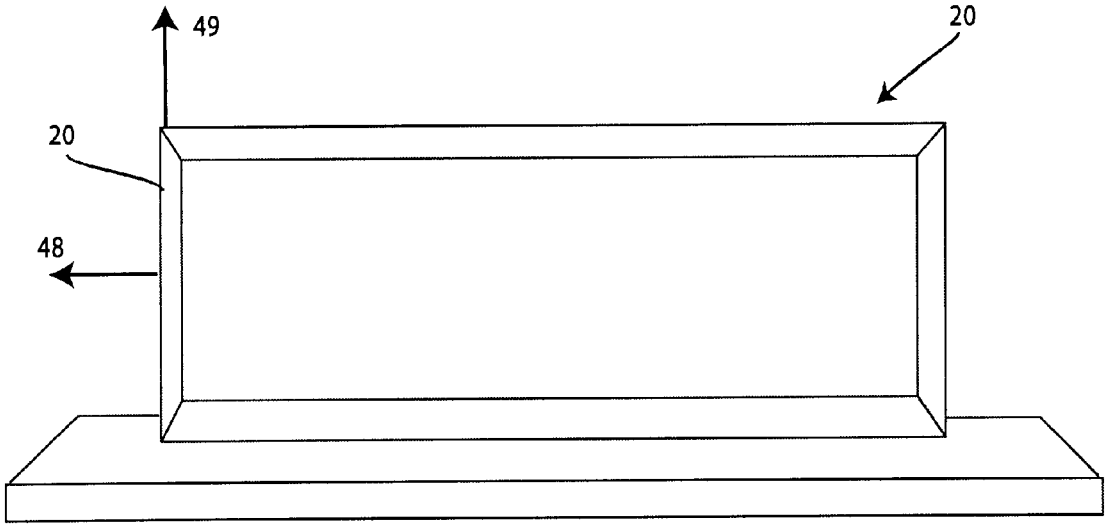
FIG. 8 is a back side view of a first embodiment of the invention in the folded up position.
Figure 9:
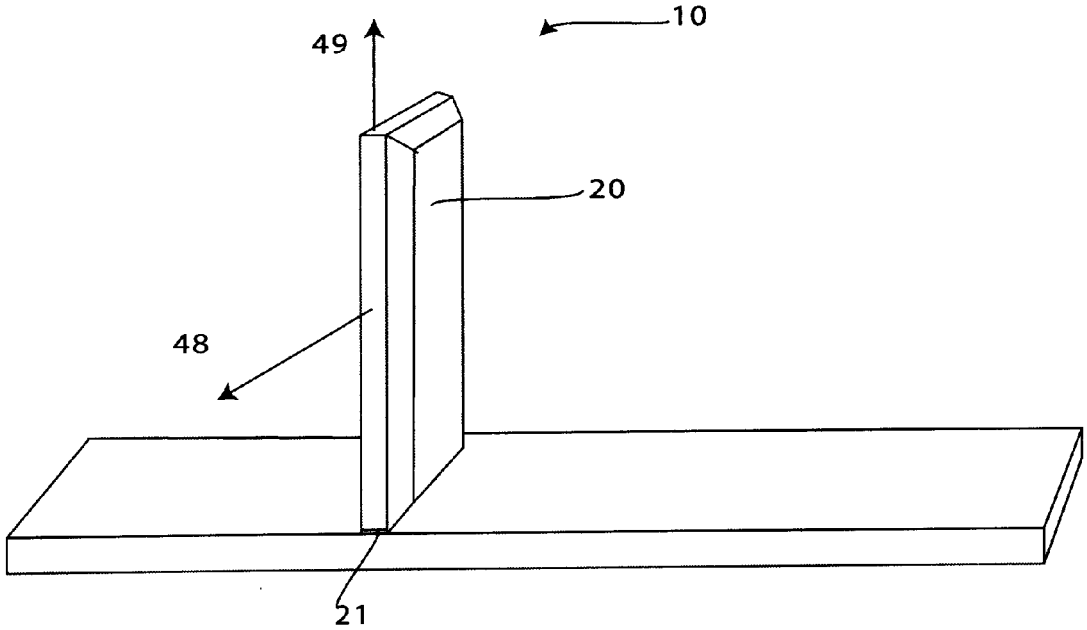
FIG. 9 is a perspective view of the first embodiment of the invention in the folded up position.

As shown in FIG. 5, there is also at least one catch block 50 that is disposed within catch basin 20, wherein as shown in FIG. 6, this catch block 50 contains an elevated first end 52 that is designed to receive spacer bar 14" of second rack 14. This spacer bar 14" of second rack 14 fits snugly inside catch block 50 so that the device can be folded down in a compact position as shown in FIG. 5 and then tilted up on back wall 21 of catch basin 20 for storage as shown in FIGS. 8 and 9.

In addition, there is a longitudinal axis 48 which extends along the longer side of catch basin and also extends parallel to the axes of rotation of racks 12 and 14 as they are folded up or down. Furthermore, there is also shown latitudinal axis 49 which extends along the shorter of the two sides of catch basin 20 and also serves as a midpoint at which the device is weight balanced.

Thus, once racks 12, 14, and 30 are folded down, substantially half of the weight of the device is disposed above a plane extending parallel to latitudinal axis 49, and substantially half of the weight of the device is disposed below this plane. When device 10 is in its substantially flat position, catch basin 20 can be folded up to be free standing upright on wall 21 of catch basin 20. In this way, once device 10 has been fully collapsed, device 10 only takes up a minimal amount of counter space.

Figure 7:
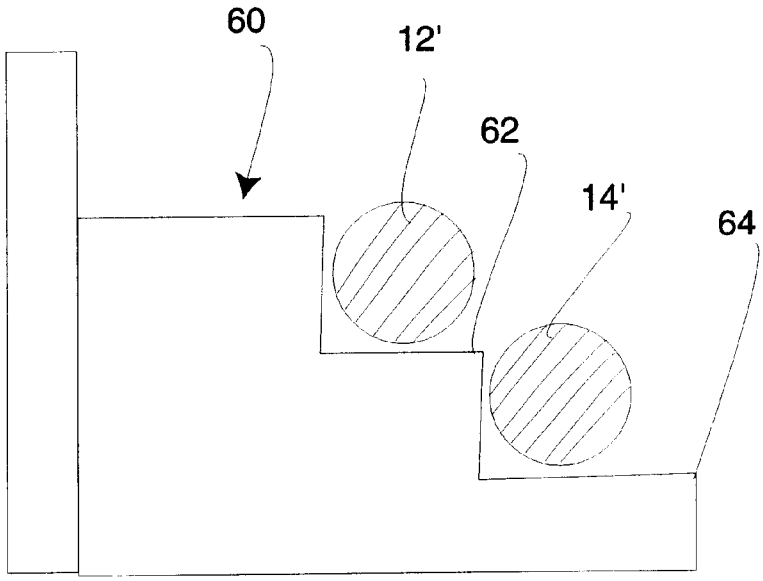
FIG. 7 is a side view of a first embodiment of a back support block supporting both the first adjustable rack and the second adjustable rack.

As shown in FIG. 7, there is also a mid range support block 60 that is disposed within the catch basin 20. This support block 60 contains a series of steps 62 and 64 that are designed to support spacer bars 12' and 14' in a substantially vertical manner. In that way, spacer bars 12' and 14' do not bend or bow in a middle region due to the weight of pots or plates placed upon racks 12 and 14.

As shown in FIGS. 8 and 9 the catch basin 20 can be folded up in a substantially vertical manner wherein the entire device can be positioned in an upright manner so that it can stand freely on a flat surface. The components of device 10 are positioned within catch basin 20 so that when racks 12, 14, and tray 30 are collapsed for storage it forms a balanced device along axis 49 that can be supported upright by wall 21 on catch basin 20. Thus, when the device is tilted up on its edge, with axis 49 extending substantially vertically, this device can remain free standing because the weight of the device in this collapsed position is balanced on either side of axis 49.

Figure 10:
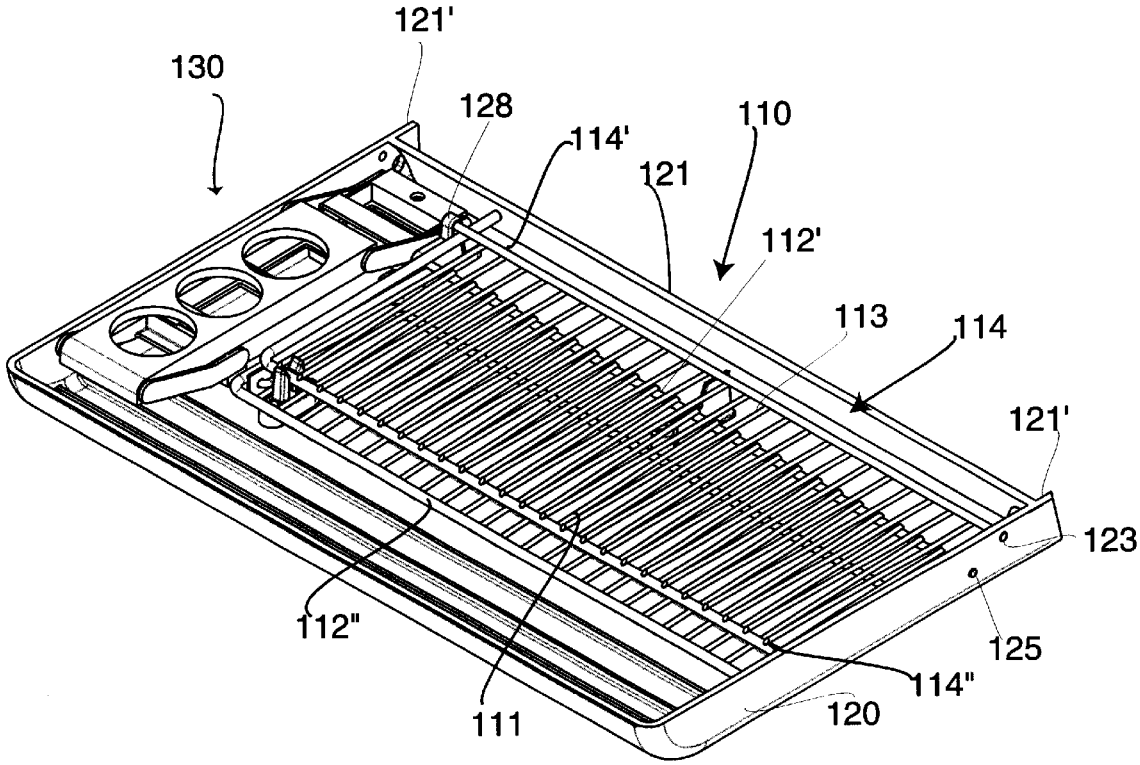
FIG. 10 is a perspective view of the second embodiment of the invention.

FIG. 10 is a perspective view of the second embodiment of the invention. There is shown a folded down device 110 that is for drying plates, pots, pans and silverware. There is a first rack 112, that is rotatably attached to a catch basin 120. In addition, there is a second rack 114 that is also rotatably attached to catch basin 120. Catch basin 120 differs from catch basin 20 in the first embodiment in that catch basin 120 has rounded edges, and a curved back wall 121. Curved back wall 121 is designed to catch and retain water inside catch basin 120. In addition, curved back wall 121 is designed to add additional lateral support due to its curved design. Back wall 121 is curved, so that it provides additional lateral support because this back wall cannot bend along an edge as with a flat back wall.

Both first rack 112 and second rack 114 contain a series of parallel extending bars 111 and 113 respectively. Parallel extending bars 111 and 113 are spaced apart by first and second spacer bars 112' 112" 114' and 114" respectively. As in the first embodiment, these parallel extending bars are spaced apart to receive a series of plates or pots while allowing water to drip into basin 120.

Figure 11:
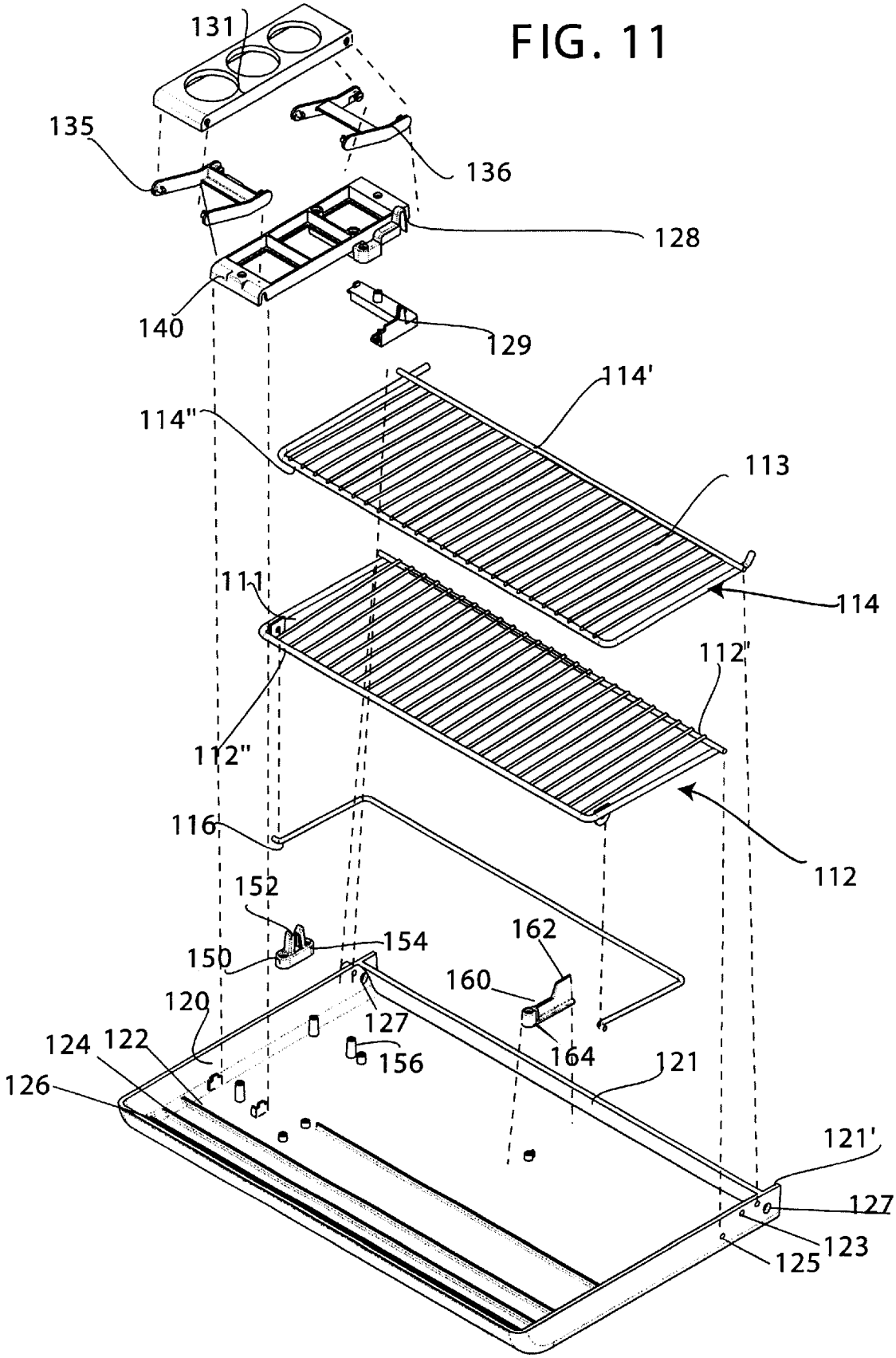
FIG. 11 is a perspective-exploded view of the second embodiment of the invention.

Spacer bars 112' and 114' are attached at one end in holes 123 and 125 in catch basin 120 respectively, while being attached at an opposite end to a rack support 128 and to a rim 129 on utensil basket 140 (see FIG. 11). Support rack 128 and rim 129 are designed to have substantially cylindrical recesses that are designed to receive spacer bars 112' and 114' on racks 112 and 114 respectively.

FIG. 11 shows an exploded perspective view of the second embodiment of the dish rack. Basin 120 has holes 123 and 125 designed to receive racks 112 and 114. In addition, drainage hole 127 is also shown adjacent to holes 123 and 125. Catch block 150 and support block 160 can be coupled to basin 120 via a series of screws. These screws are screwed into a series of bosses 156. Support block 160 consists of an elevated region 162 and a lower region 164 having a hole for allowing a screw to screw into basin 120.

In addition, support strips 122, 124, and 126 are shown extending parallel to each other within basin 120. These support strips 122, 124, and 126 provide support for support bar 116 which supports rack 112 at an angle. For example, support bar 116 can be set into first support strip 122 for a first elevated state, or set into support strip 124 for a second elevated state, or finally into support strip 126 for a third elevated state.

The utensil rack 130 is also shown. This rack 130 consists of a base 140, a series of arms 135 and 136 and a top plate 131. Top plate 131 contains a series of open holes designed to allow a user to place a series of utensils within utensil rack 130.

Figure 12:
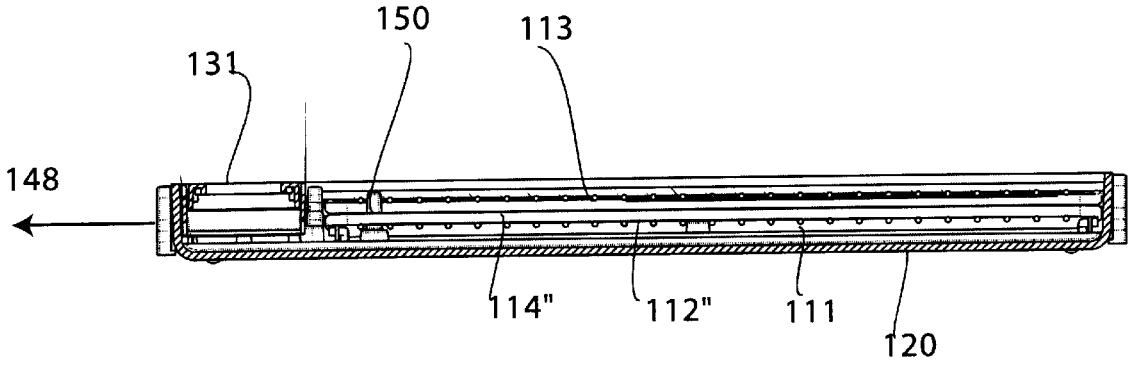
FIG. 12 is a side view of a portion of the second embodiment of the invention.

FIG. 12 shows a cross-sectional front view of the second embodiment of the invention. As shown in this view, catch block 150 is shown as offset from a center region wherein catch block 150 is shown adjacent to rack 130. In addition, in this view, spacer bars 112" and 114" are shown wherein spacer bar 114" is shown as stacked on top of spacer bar 112". Furthermore, spacer bar 114" is shown connected snug inside catch block 150 wherein spacer bar 112" is locked inside spacer bar 114". With this view, the compact design of the second embodiment of the invention is shown wherein both racks 112, 114, and 130 are shown folded inside of basin 120 so that it forms a compact balanced design. Thus, this design allows the second embodiment of the invention to stand up on a back edge as shown in FIGS. 8 and 9.

Figure 13:
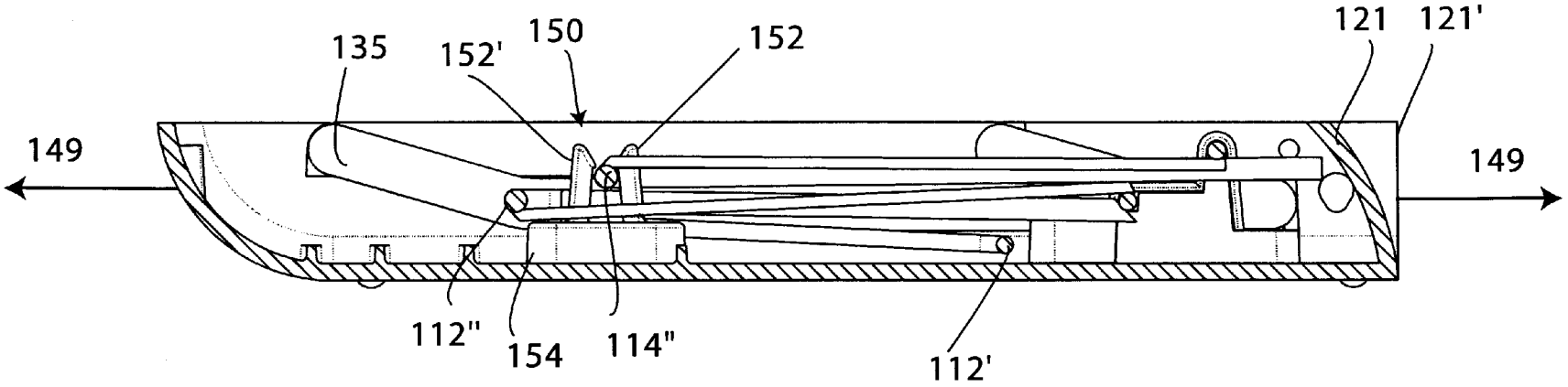
FIG. 13 is an opposite side view of the second embodiment of the invention in relation to FIG. 12.

FIG. 13 shows a side view of the second embodiment of the invention. With this view, rack 114 is shown fixed inside block 150 wherein legs 152 are shown wrapping around spacer bar 114" to hold spacer bar 114" inside. Legs 152 extend at an angled rate up from base 152 and are designed to have a protruding point 152' to allow spacer bar 114" to snap into block 150. With this view, longitudinal axis 148, and latitudinal axis 149 are shown. Longitudinal axis 148 extends along substantially parallel to the axes of rotation of racks 112, and 114. Latitudinal axis 149 extends substantially perpendicular to longitudinal axis 148, wherein latitudinal axis 149 extends parallel to a plane that divides the weight evenly above and below the plane to balance the device sufficiently to allow it to stand up on its end. Thus this weight balance of the device creates a free standing device that can be stowed away on a base end when not in use.

Figure 14:
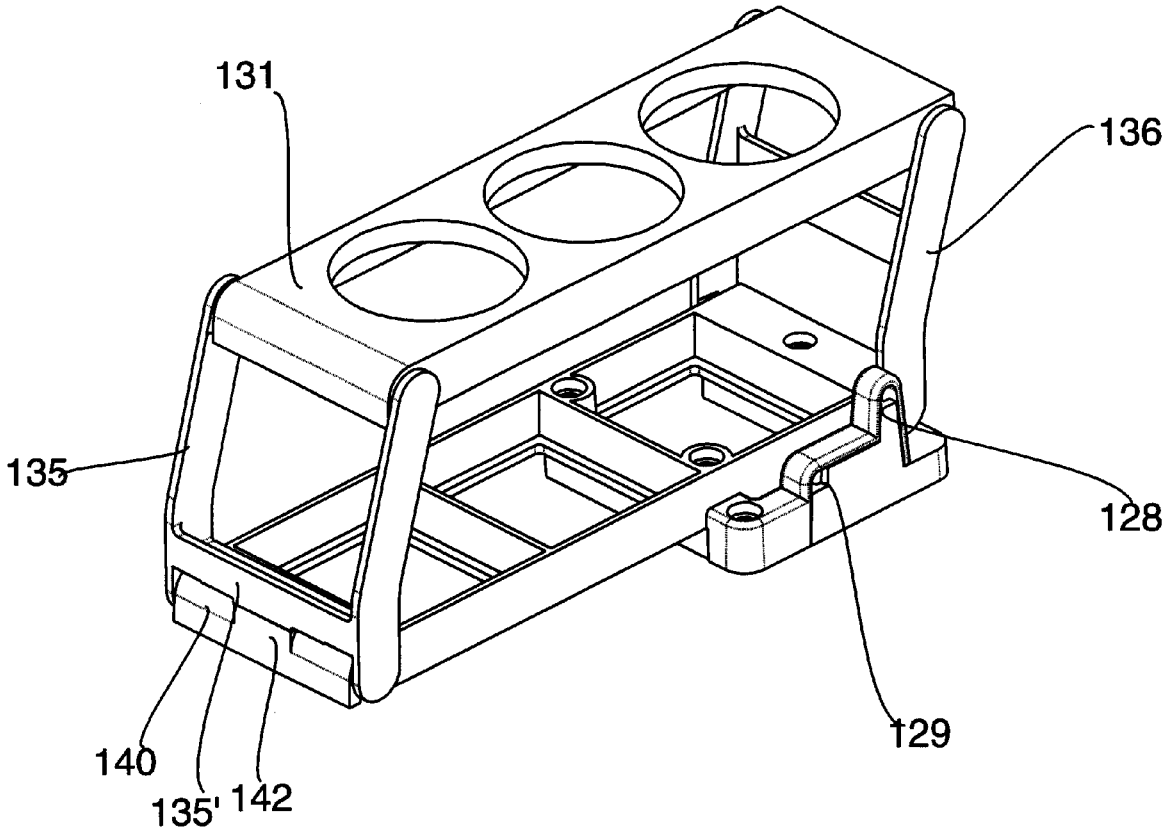
FIG. 14 shows a perspective view of the second embodiment of the utensil rack.

FIG. 14 shows a perspective view of rack 130 which is designed as a utensil rack to hold utensils in an upright manner. As shown in this view, rack support 128 and rim 129 are shown having substantially cylindrical recesses designed to receive spacer bars 112' and 114'. There is also a base 140 that has a flange 142 which extends out of base 140. When rack 130 is moved from its compact position as shown in FIG. 13 to its upright position shown in FIG. 14, top plate 131 is raised up while legs 135, and 136 rotate within base 140. As legs 135 rotate up, a cross plate 135' snaps over flange 142. Once cross plage 135' snaps over flange 142, it locks rack 130 in place securing top plate 131 in place.

Essentially, this device is unique because the first rack 12, 112 in conjunction with the adjustable support bar 16, 116 are designed to create both a dish drying rack and a pot drying rack. When the substantially horizontal first rack 12, 112 is supported above a horizontal position, with the adjustable support bar 16, 116 being supported by one of the support strips 22, 24, 26, 122, 124, 126, the device is designed to support dishes and small to medium sized pots. When the first or substantially horizontal support rack 12, 112 is raised above its horizontal position, this rack gains clearance above the catch basin 20, 120 creating an area to receive plates through its parallel extending bars 11, 111. In addition, with the substantially horizontal rack 12, 112 in this raised position, it creates an angled surface which forces plates to also extend through the second opposite angled, substantially vertical rack. While the device in this position is primarily designed to receive plates, small to medium sized pots can also be placed on the first or substantially horizontal rack for drying.

This device can also be adjusted to form a pot drying rack. This pot drying rack is formed when the first or substantially horizontal rack 12, 112 is extended out in a substantially horizontal manner, wherein the support bar 16, 116 is extended out to a series of support elements 25 (See FIG. 5). When the support bar 16, 116 it is extended out, it forms an additional drying surface at substantially the same elevation as the first rack. Because of this additional surface area for drying, this first rack along with the support bar is designed to receive many pots or pans, of small, medium or large size. Now pots with a larger diameter than the width of the first rack can be placed on this first rack and extend out to be supported by this support bar resting on the support elements 25.

In addition, utensil rack 30, 130 can be folded down into a substantially horizontal position at an elevation similar to the elevation of this substantially horizontal rack 12, 112. With this design, the utensil rack 30, 130 in its folded down position forms an additional pot drying surface which can receive pots that are either placed directly onto the folded down utensil rack or pots placed onto the first drying rack but hang over this first drying rack.

When the device is in this position it is a pot drying rack because when the first rack 12, 112 is in its substantially horizontal position, it can no longer support dishes. This is because this first rack 12, 112 is far closer to the bottom of the support basin 20, 120 thereby cutting off a region to allow the plates to slide through the parallel extending bars. In addition, when the first rack 12, 112 is in this position, it no longer supplies lateral support to the dishes. This lateral support is required to support dishes because the lateral support results in the first rack 12, 112 pushing the dishes into the second, substantially vertical rack 14, 114 keeping the dishes from falling over.

This device is also unique because it can be tilted up on its end and allowed to stand on a base so that this device can be placed out of the way. This feature occurs because this device contains a unique base that allows this device to stand on its end and because this device is uniquely balanced along a latitudinal axis which extends substantially horizontal when the device is in use on a counter-top but extends substantially vertical when the device is tilted up for storage.

The base, which connects to the device can be made from any desired shape, but is designed to allow the device to stand up on an end for storage. This base is in the form of but not limited to: a flat back face 21, extending along a latitudinal axis 48, series of legs 121' spaced apart by a curved back face 121 extending along a latitudinal axis 148, a separate plate connected to the basin (not shown), or any other shape to create a support surface on a counter top.

In addition, the design of this device creates a weight balanced device once it is in its compact form. This weight balance allows the device to be free standing on its base so that this device does not need any additional fixtures or support from an adjacent wall or counter surface. For example, once all three racks: the first rack 12, 112, second rack 14, 114 and utensil rack 30, 130 have been folded down to compact the device, this device is balanced along its latitudinal axis 49, 149. Now the device can be folded up on its base to be stowed away as a free standing device.

Accordingly, while two embodiments of the present invention have been shown and described, it is to be understood that many changes and modifications may be made thereunto without departing from the spirit and scope of the invention as defined in the appended claims.

What is claimed is:

1. A device for drying objects comprising:

a) at least one basin having at least one side wall;

b) at least one rack, disposed in, and rotatably coupled to said at least one basin, and having a plurality of substantially parallel spaced bars, spaced apart a sufficient distance for receiving a plate therebetween, wherein said at least one rack can be adjusted to at least one support position to support plates or pots in said at least one basin, and wherein said device can be positioned upright on said at least one side wall for storage; and at least one additional rack comprising:

i) a top plate;

ii) a base section connected to said at least one basin; and iii) a plurality of legs connecting said base section to said top plate wherein some of the objects for drying can be placed in said at least one additional rack and supported by said top plate.

2. The device as in claim 1, wherein said plurality of legs comprise at least two pairs of legs with a first pair positioned at a front end of said top plate and a second pair positioned at a back end of said top plate.

3. The device as in claim 2, further comprising at least one support bar connecting at least one of said at least two pairs of legs together.

4. The device as in claim 3, further comprising a flange disposed on said base section, wherein when said top plate is moved into an upright position, said at least one support bar snaps over said flange to lock said top plate into position.

* * * * *